United States Patent [19]

Paramski

[11] Patent Number: 4,915,293

[45] Date of Patent: Apr. 10, 1990

[54] SHELTERED AND REPOSITIONABLY MOUNTED ENCLOSURE

[75] Inventor: Walter P. Paramski, Libertyville, Ill.

[73] Assignee: Drake Construction Company, Antioch, Ill.

[21] Appl. No.: 224,720

[22] Filed: Jul. 27, 1988

[51] Int. Cl.[4] ..... B65D 91/00

[52] U.S. Cl. ..... 232/39; 404/10; 256/13.1

[58] Field of Search ..... 232/39; 404/10, 11; 256/13.1, 19

[56] References Cited

U.S. PATENT DOCUMENTS

| | | | |
|---|---|---|---|
| 3,332,666 | 7/1967 | Gray | 256/13.1 |
| 3,740,881 | 6/1973 | Finger | 40/125 H |
| 3,913,518 | 10/1975 | Kaplan | 116/63 P |
| 4,061,435 | 12/1977 | Schmanski et al. | 404/10 |
| 4,269,534 | 5/1981 | Ryan | 404/10 |
| 4,286,747 | 9/1981 | Deike | 232/39 |
| 4,486,117 | 12/1984 | Blau | 404/10 |
| 4,511,281 | 4/1985 | Schmanski | 404/10 |
| 4,636,108 | 1/1987 | Duckett | 404/10 |
| 4,729,690 | 3/1988 | Lavender et al. | 404/10 |
| 4,792,088 | 12/1988 | Bonnell | 232/39 X |

*Primary Examiner*—Robert W. Gibson, Jr.
*Attorney, Agent, or Firm*—Thomas W. Speckman; Douglas H. Pauley

[57] ABSTRACT

A sheltered and repositionably mounted enclosure having a housing secured to and supported by a mounting post. The mounting post is positioned within a mounting sleeve. An outer ring-shaped gasket is attached to an inner wall of the mounting sleeve. An inner ring-shaped gasket is attached to a mounting post. The inner ring-shaped gasket abuts the outer ring-shaped gasket thereby forming a sealed space within the mounting sleeve and supporting the mounting post within the mounting sleeve. A retainer having a mound shape with a depression in the middle of the mound is attached to the bottom of the mounting sleeve. A mounting post bottom of the mounting post abuts the depression of the mound and thus the mounting post is supported in an approximately vertical position within the mounting sleeve. The mounting post is repositionable within the mounting sleeve and with respect to the retainer after the mounting post is displaced from the depression of the retainer.

29 Claims, 2 Drawing Sheets

SHELTERED AND REPOSITIONABLY MOUNTED ENCLOSURE

BACKGROUND OF THE INVENTION

1. Field of the Invention

A sheltered and repositionably mounted enclosure having a housing secured to and supported by a mounting post. The mounting post is repositionably secured within a mounting sleeve and the mounting post bottom rests upon a mound-shaped retainer having a depression located in the middle portion of the mound.

2. Description of the Prior Art

Mailboxes, newspaper enclosures, signs and other objects are typically mounted on a post and the lower portion of the post is buried in the ground or set in a foundation. Such mailboxes, newspaper enclosures, signs or other objects are often located near a road or near an area that is susceptible to accidental impact or applied forces. When such objects are struck, the mounting post often fractures or bends into a position where the damage cannot be repaired. Thus a need exists for a mounting design which allows the mounting post to deflect upon impact or force applied to the mounting post.

Existing methods to mount a post in the ground include digging a hole in the ground, setting the mounting post in the hole, pouring concrete in the hole and allowing the concrete to set. Another existing method of mounting a post includes driving the post into the ground and supporting the post with the surrounding ground. Neither method prevents decay of the mounting post. If the mounting post is fractured in either method, the mounting post must be again driven into the ground or a new hole excavated and new concrete poured.

Finger, U.S. Pat. No. 3,740,881 teaches a placard holding display assembly having a vertical panel with horizontal guides which hold placards. A base having side walls constructed from a resilient material holds the panel in an upright position during normal wind loads. As wind loads increase against the vertical panel, the base side walls distort from their normal shape and allow the panel to tip in the direction of the prevailing winds. A decrease in the wind loads causes the base side walls to spring back to their normal shape thus returning the vertical panel to an upright position.

Kaplan, U.S. Pat. No. 3,913,518 teaches a traffic marker having three replaceable resilient parts. The upright column is a resilient tube, the base is molded rubber, and the bellows connecting the tube and the base is also a resilient rubber. The bellows functions as a hinge member. The upright column has a lower flared end which snugly fits within a top opening of the bellows. The lower portion of the bellows seats within an opening in the base. Each of the three resilient parts can be replaced in case of damage to any part.

Schmanski et al, U.S. Pat. No. 4,061,435 teaches a roadway delineator having a post which supports a sign o guide marker. The post is designed to yield on impact and will substantially resume its original configuration after the impact force has been removed. The post is a single member and has longitudinal shear planes that allow it to split along such shear planes upon impact, thereby reducing the tendency of the post to shear transversely.

Ryan, U.S. Pat. No. 4,269,534 teaches a replaceable guidepost which supports a road marker and the like. A flexible tubular post member is secured to a ground surface such as a roadway. The tubular post has a lower flanged portion. The base member is adapted to receive and engage the lower flange portion of the tubular post. A collar member is positioned over the base and the lower portion of the tubular post, thereby clamping the post between the base and the collar and affixing the base member to the ground surface. A damaged post member can be replaced by removing a mounting cap.

Blau, U.S. Pat. No. 4,486,117 teaches a flexible traffic standard having an anchor support assembly consisting of a hollow cylindrical tube with a driving point at one end. A tempered spring steel strap is disposed within the hollow cylindrical tube and the spring steel strap is secured by compression bolts. The flexible traffic standard has a rain boot which prevents water from running down into the tube and a rain cap which prevents the entry of water through the top of the flexible standard. The spring steel strap is reversely folded at its midpoint and forms a pair of upwardly extending resilient arms which are laterally outwardly offset by means of a twist in the spring steel at the midpoint reverse point. The flexible traffic standard deflects upon impact into an out-of-the-way position to allow an impacting vehicle to pass across it and when the impacting force is removed, the flexible traffic standard resiliently restores to its normal use position.

Schmanski, U.S. Pat. No. 4,511,281 teaches a road-surface mountable delineator support member having a resilient wall structure capable of maintaining an attached delineator in upright, operational orientation as a traffic guide and capable of surviving repeated vehicle impacts. The wall structure has an integrally formed neck, shoulder and large collapsible body. The larger collapsible body section receives most of the vehicle impact forces and the wall structure deforms rather than the attached delineator structure. The support base can be adhesively attached to a road surface and can be adapted for attachment of tubular delineator structures with various reflective formats.

Duckett, U.S. Pat. No. 4,636,108 teaches a flexible surface mounted delineator having an upstanding flexible marker. The flexible marker has one opening in a bottom wall to receive a fastener such as a bolt. The flexible marker has another opening through a side wall to accommodate a wrench for the purpose of tightening or releasing the bolt. The delineator and mounting plate can be replaced with only the use of a standard wrench.

A spring back mailbox pole is another existing design of a flexible mounting post. The spring back mailbox pole has a heavy steel tubing with a stout, coiled spring joint welded to the steel tubing. One end of the coiled spring is secured to a length of steel tubing with a conventional mailbox mounted at the opposite end of the length of steel tubing. The opposite end of the coiled spring is secured to a second length of steel tubing. The second length of steel tubing is anchored in concrete.

SUMMARY OF THE INVENTION

It is an object of this invention to provide a sheltered and repositionably mounted enclosure that can be retracted upon impact or a force applied to the enclosure or mounting post.

It is another object of this invention to provide a sheltered and repositionably mounted enclosure that does not fracture upon impact or a force applied to the enclosure or mounting post.

It is yet another object of this invention to provide a sheltered and repositionably mounted enclosure that can be reinstalled or repositioned in its original mounted position after being forced out of such mounted position.

It is still another object of this invention to provide a sheltered and repositionably mounted enclosure having a mounting post designed to break at a certain location upon impact or a force applied to the enclosure or mounting post.

In a preferred embodiment of this invention, a sheltered and repositionably mounted enclosure has a housing secured to and supported by a mounting post. The mounting post is positioned within a mounting sleeve. An outer ring-shaped gasket is attached to the wall, inner or outer, of a mounting sleeve. An inner ring-shaped gasket is secured to the mounting post. The inner ring-shaped gasket has a downward sloping outer side. The outer ring-shaped gasket has an upward sloping inner side. The downward sloping outer side of the inner ring-shaped gasket contacts the upward sloping inner side of the outer ring-shaped gasket and thus forms a sealed space within the mounting sleeve and fixes the mounting post in an approximately vertical position.

The mounting post bottom of the mounting post is retained in a retainer having a mound shape with a depression in the middle portion of the mound. The retainer is attached to a mounting sleeve bottom of the mounting sleeve. The retainer supports and fixes the mounting post in an approximately vertical position. The mounting post is repositionable within the mounting sleeve and with respect to the retainer after the mounting post is displaced from the depression of the retainer.

The housing has an access door which slidably mounts within an access door channel. The access door seals the housing from weather. In one embodiment of this invention, the housing and the mounting post are one piece. In another embodiment according to this invention, the housing has a housing neck secured to the housing. A support arm has a housing end opposite a mounting post end. The housing end of the support arm is secured to the housing neck. The mounting post end of the support arm is secured to the mounting post.

In another embodiment according to this invention, the mounting post has a breakable section located above a mounting sleeve top of the mounting sleeve and below a support arm bottom of the support arm. An impact or force applied to either the housing, support arm, or mounting post will cause the breakable section to fracture before either the housing, support arm, or mounting sleeve is damaged.

In a preferred embodiment of this invention, the outer ring-shaped gasket has a plurality of through holes and the mounting sleeve has a plurality of through slots which align with the through holes of the outer ring-shaped gasket. The through slots of the mounting sleeve are positioned approximately vertically. An outer gasket bolt extends through the through hole of the outer ring-shaped gasket and the through slot of the mounting sleeve. An outer gasket washer fits over the outer gasket bolt. An outer gasket nut matingly engages with the outer gasket bolt thereby drawing the outer ring-shaped gasket against an inner wall of the mounting sleeve. The outer surface of the outer ring-shaped gasket contacts the inner wall of the mounting sleeve and forms a seal between the outer ring-shaped gasket and the inner wall of the mounting sleeve.

In another embodiment according to this invention, the mounting sleeve has at least one curved notch positioned at a mounting sleeve top of the mounting sleeve. At least one peg is secured to an outside wall of the mounting post. The peg mates with the notch and supports the mounting post in a fixed approximately vertical position with respect to the mounting sleeve. Upon a rotational force applied to the mounting post, the peg can move from the lower to upper portion of the notch thereby allowing the mounting post to rotate with respect to the mounting sleeve.

In yet another embodiment according to this invention, the mounting post can be positioned to prevent rotation of the mounting post with respect to the mounting sleeve. The mounting post fits within the mounting sleeve. A keeper bar is secured to an outside wall of the mounting post. The mounting sleeve has an inner wall groove located on the inner wall of the mounting sleeve. The keeper bar mates with the inner wall groove and prevents the mounting post from rotating with respect to the mounting sleeve. In another embodiment according to this invention, the mounting post fits within the mounting sleeve. The mounting post has an outer wall surface with an elliptical cross section. The mounting sleeve has an inner wall surface with an elliptical cross section. The mounting post partially rotates within the mounting sleeve and at a locking position the mounting post rotates into a snug fit within the mounting sleeve thereby preventing rotation of the mounting post with respect to the mounting sleeve. The mounting post and mounting sleeve can be designed such that a sufficient impact or force applied to the enclosure creates a torque on the mounting post and rotates the mounting post and enclosure to an out-of-the-way position.

The mounting post can have flats for rotating the mounting post with respect to the mounting sleeve. The mounting post flats are secured to the outside surface of the mounting post at a location above the inner and outer ring-shaped gaskets. The mounting post can also have a section of external threads and the inner ring-shaped gasket can have mating internal threads. The internal threads of the inner ring-shaped gasket matingly engage with the external threads vertically displacing the inner ring-shaped gasket with respect to the mounting post.

In another embodiment according to this invention, the inner and outer ring-shaped gaskets can be replaced by one rib-shaped gasket. The rib-shaped gasket has a rib-shaped gasket outer side which attaches to the inside wall of the mounting sleeve. The rib-shaped gasket has an approximately right triangle cross section with rounded corners. A mounting sleeve side of the rib-shaped gasket attaches to the inside wall of the mounting sleeve. A corner of the approximately right triangle cross section which opposes the mounting sleeve side contacts the outside surface of the mounting post. The mounting post pivots at the rib-shaped gasket upon an impact or force applied to the enclosure, support arm, or mounting post.

DESCRIPTION OF THE PREFERRED EMBODIMENTS

Figure 1:
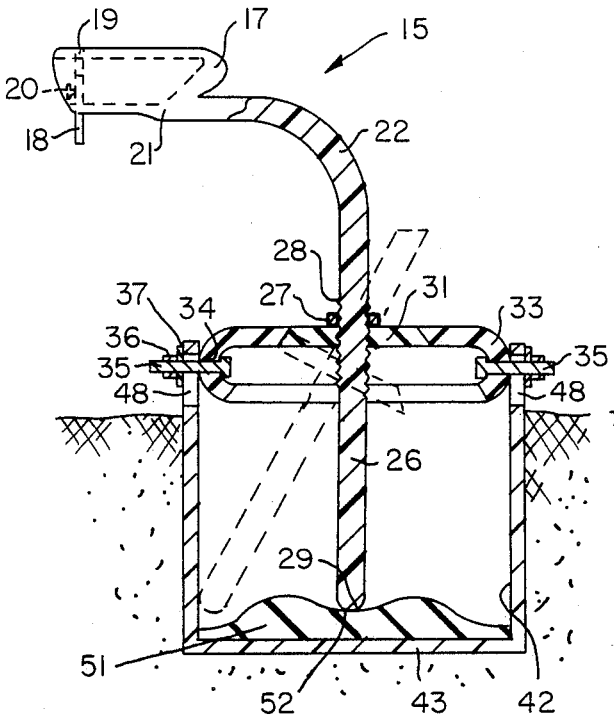
FIG. 1 shows a partial cross-sectional side view of a sheltered and repositionably mounted enclosure according to one embodiment of this invention.
Figure 2:
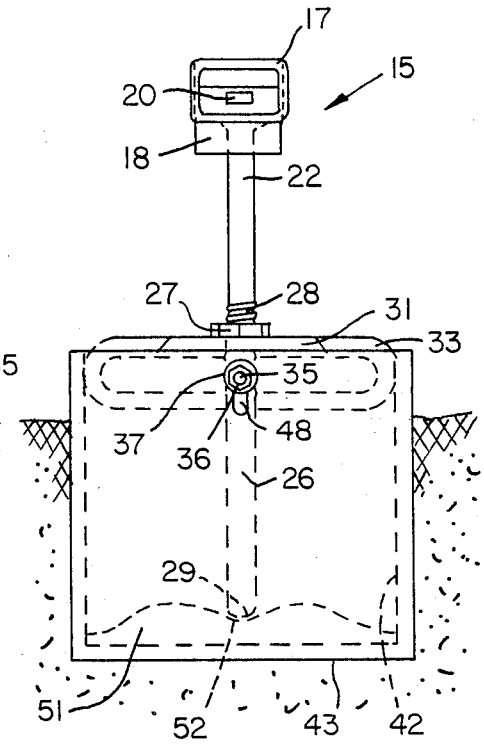
FIG. 2 shows a front view of a sheltered and repositionably mounted enclosure as shown in FIG. 1.

FIGS. 1 and 2 show a sheltered and repositionably mounted enclosure 15 according to a preferred embodiment of this invention. Housing 17 has access door 18 slidably mounted within access door channel 19 of housing 17. Lifting handle 20 is secured to access door 18. In an open position of access door 18, lifting handle 20 abuts housing 17 thereby preventing access door 18 from completely sliding out of access door channel 19. It is apparent that access door 18 can be prevented from sliding completely out of access door channel 19 by access door 18 having mechanical stops, mechanical latches, or any other suitable stop means known to the art. It is also apparent that lifting handle 20 can be a latching handle which locks access door 18 into a closed position. Other locking or latching mechanisms known to the art can be used to lock or fix access door 18 into a closed position thereby sealing and weatherproofing housing 17. It is also apparent that access door 18 can be mounted on hinges and swing open and closed rather than slide open and closed as shown in FIGS. 1, 2, 3, 4, 6, and 9.

Figure 6:
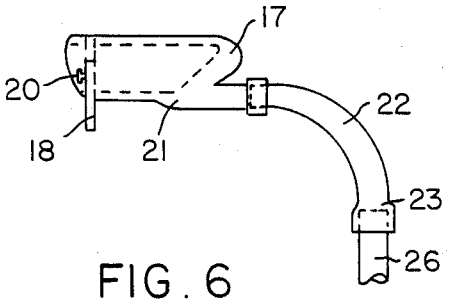
FIG. 6 shows a side view of a housing, support arm, and mounting post according to one embodiment of this invention.

As shown in FIGS. 1, 2, 3 and 4, housing 17 and support arm 22 are one piece. As shown in FIG. 6, housing 17 is secured to support arm 22 which is secured to mounting post 26. Although FIG. 6 shows three components, housing 17, support arm 22 and mounting post 26, it is apparent that any number of support members can be used as a transition from the generally vertical position of mounting post 26 to the generally horizontal position of housing 17.

FIGS. 1 and 2 show mounting post flats 27 secured to mounting post 26 above inner gasket 31. Inner gasket 31 is secured to mounting post 26. Inner gasket 31 can be secured to mounting post 26 at any location between retainer 51 and mounting post flats 27, preferably at a distance above retainer 51 sufficient to provide vertical stability of mounting post 26. It is apparent that inner gasket 31 can be secured to mounting post 26 by having external threads 28 of mounting post 26 engage with internal threads of gasket 31, by welding inner gasket 31 to mounting post 26, by using an adhesive connection, a molded connection, or by any other suitable securing method known to the art.

In a preferred embodiment according to this invention, outer gasket 33 is attached to inner wall 42 of mounting sleeve 41. It is apparent that outer gasket 33 can also fit over mounting sleeve 41 so that outer gasket 33 is attached to the outer wall of mounting sleeve 41. As shown in FIG. 1, outer gasket 33 has curved sides with a plurality of through holes 34 in the curved portion of outer gasket 33. Mounting sleeve 41 has a plurality of approximately vertical through slots 48 which align with through holes 34. Outer gasket bolt 35 extends through each through hole 34 and through slot 48. Outer gasket washer 37 fits over outer gasket bolt 35 and the threads of outer gasket nut 36 matingly engage with the threads of outer gasket bolt 35. Tightening outer gasket bolt 35 with respect to outer gasket nut 36 draws the sides of outer gasket 33 into tight contact with inner wall 42 thus forming a seal within mounting sleeve 41.

The vertical through slots 48 allow for vertical adjustment of outer gasket 33 relative to mounting sleeve 41. It is apparent that outer gasket 33 can have through slots in lieu of through holes 34 to accomplish vertical adjustment of outer gasket 33 relative to mounting sleeve 41, or any other suitable adjustment method can be used to vertically displace outer gasket 33 relative to mounting sleeve 41. Although it is not essential that outer gasket 33 form a seal between outer gasket 33 and inner wall 42, such a sealed connection will prevent water, dirt, sand, or any other foreign materials from entering the space within mounting sleeve 41. A buildup of such foreign material can be detrimental to the mobility of mounting post 26 within mounting sleeve 41. Such reduction in mobility of mounting post 26 within mounting sleeve 41 can prevent the repositioning capabilities of mounting post 26 according to this invention.

Mounting post 26 can have any cross-sectional shape, preferably a circular cross section. The inner hole of inner gasket 31 has a cross-sectional shape that mates with the outer surface cross-sectional shape of mounting post 26, preferably mounting post 26 has a circular cross-sectional shape. Inner gasket 31 can have any cross-sectional shape, preferably a circular cross section, giving inner gasket 31 an overall ring shape. The inner hole of outer gasket 33 has a cross-sectional shape that mates with the outer cross-sectional shape of inner gasket 31, preferably a circular cross section. The outer surface of outer gasket 33 can have any cross-sectional shape, preferably a circular cross section. Mounting sleeve 41 can have any cross-sectional shape that mates with the cross-sectional shape of the outer surface of outer gasket 34. Preferably, mounting sleeve 41 has a hollow cylindrical shape.

Mounting sleeve bottom 43 is secured to mounting sleeve 41. Retainer 51 is secured to mounting sleeve bottom 43. Retainer 51 has an overall mound shape with depression 52 located in the middle portion of retainer 51. Mounting post bottom 29 abuts and rests in depression 52 of retainer 51. Retainer 51 supports mounting post 26 in an approximately vertical position. A sufficient impact or force applied to housing 17, support arm 22 or mounting post 26 will move mounting post 26 out of depression 52, over the mound of retainer 51 and downward into a corner where mounting sleeve 41 meets mounting sleeve bottom 43.

The ghost lines shown in FIG. 1 represent mounting post 26 in a displaced position after an impact or force has been applied to housing 17, support arm 22 or mounting post 26. In a preferred embodiment of this invention, inner gasket 31 has outer sides that slope downward and outer gasket 33 has inner sides that slope upward. The sloping edges of inner gasket 31 about the sloping edges of outer gasket 33 forming a seal when mounting post 26 is in an approximately vertical position. In the displaced position of mounting post 26, inner gasket 31 separates from outer gasket 33 and prevents any damage to support arm 22 or mounting post 26. Once mounting post 26 has been forced into a displaced position, mounting post 26 can be repositioned such that mounting post bottom 29 again abuts depression 52 of retainer 51. In such repositioned setting of mounting post 26, inner gasket 31 again abuts outer gasket 33 forming a seal and supporting mounting post 26 in an approximately vertical position.

In a preferred embodiment of this invention, mounting post 26 has rounded bottom edges or a rounded mounting post bottom 29. Such rounded bottom edges or rounded mounting post bottom 29 allow mounting post 26 to displace from depression 52 of retainer 51 in a smooth fashion without catching any edges. Mounting sleeve 41 and mounting sleeve bottom 43 can be located entirely or partially underground as shown in FIGS. 1 and 2, or above ground. It is apparent that mounting sleeve 41 and/or mounting sleeve bottom 43 can be secured to any other suitable structural frame member. It is also apparent that housing 17, preferably a mailbox of the like, can be replaced by any other object requiring a post for mounting, such as a traffic sign, information sign, curb marking, or the like. It is also apparent that a pivotal flag, retractable marker or any other suitable signaling means can be mounted on housing 17 for the purpose of informing that housing 17 is either vacant or occupied.

Figure 3:
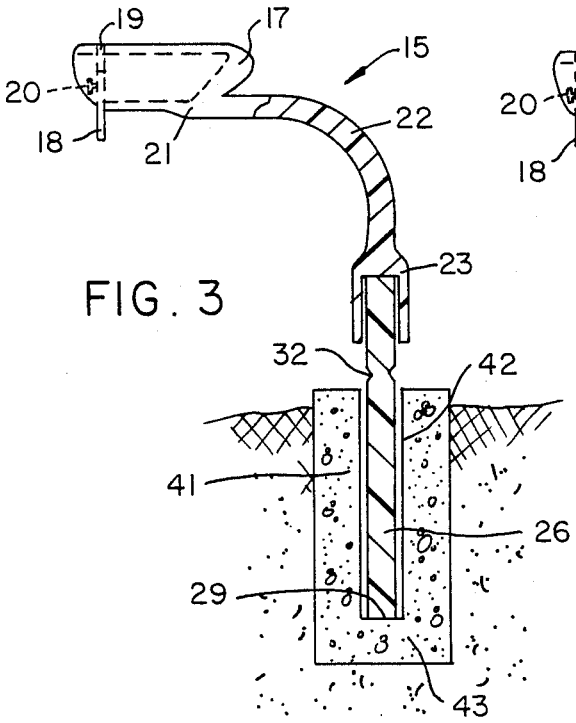
FIG. 3 shows a partial cross-sectional side view of a sheltered and repositionably mounted enclosure according to another embodiment of this invention.

FIG. 3 shows a sheltered and repositionably mounted enclosure according to one embodiment of this invention. As shown in FIG. 3, housing 17 and support arm 22 form one piece. It is apparent that housing 17 and support arm 22 can be two or more pieces such as that shown in FIG. 6. As shown in FIG. 3, support arm 22 has a lower support arm sleeve 23. Mounting post 26 either fixedly or rotably mates with support arm sleeve 23 and supports housing 17 and support arm 22. Mounting post 26 slidably fits within mounting sleeve 41 and can either be fixed or rotate with respect to mounting sleeve 41. It is apparent that mounting post 26 can have a sleeve that mates with a lower post portion of support arm 22 or any other suitable method can be used to secure support arm 22 to mounting post 26.

In a preferred embodiment of this invention, mounting post 26 has notched section 32 which creates a stress point where structural failure will first occur. Mounting post 26 can be designed with notched section 32 or any other suitable design which causes mounting post 26 to fracture before either housing 17, support arm 22, or mounting sleeve 41 upon impact or a force applied to housing 17, support arm 22, support arm sleeve 23, or mounting post 26. If fractured, mounting post 26 can be easily replaced at a lower cost than replacing housing 17 and support arm 22.

Figure 4:
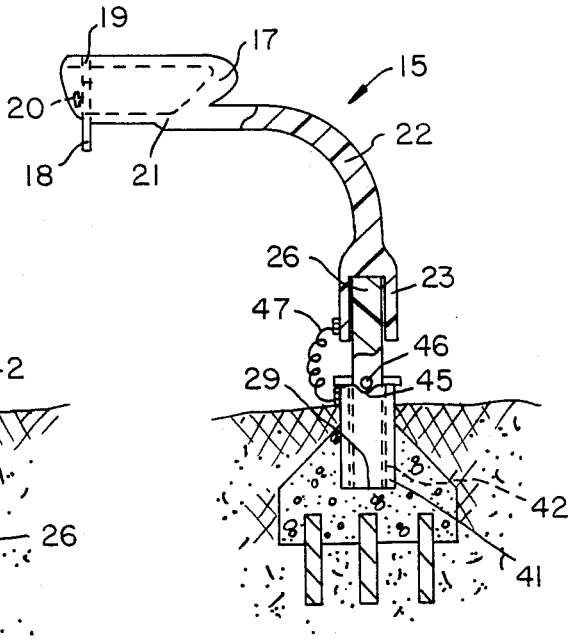
FIG. 4 shows a partial cross-sectional side view of a sheltered and repositionably mounted enclosure according to another embodiment of this invention.

FIG. 4 shows a sheltered and repositionably mounted enclosure according to another embodiment of this invention. As shown in FIG. 4, housing 17, support arm 22 and support arm sleeve 23 are one piece. Cable 47 is attached to support arm sleeve 23 and to mounting sleeve 41 to prevent housing 17 and support arm 22 from being easily vandalized or stolen. It is apparent that housing 17, support arm 22 and support arm sleeve 23 can be two or more pieces such as that shown in FIG. 6. As shown in FIG. 4, mounting post 26 either fixedly or rotably mates with support arm sleeve 23 and supports housing 17 and support arm 22. The lower portion of mounting post 26 fits within mounting sleeve 41. In one embodiment, mounting sleeve 41 has a plurality of curved notches 45 located at the top of mounting sleeve 41. Peg 46 is secured to mounting post 26 by a welded connection, screwed connection, molded connection, or the like. Peg 46 positioned within curved notch 45 supports mounting post 26 in a vertical position and allows mounting post 26 to rotate if a sufficient torque force is applied to housing 17, support arm 22, support arm sleeve 23, or mounting post 26. Upon such applied torquing force, peg 46 slides from the lower to upper section of curved notch 45 thereby allowing post 26 to rotate with respect to mounting sleeve 41. In another embodiment, curved notches 45 are deep enough to prevent mounting post 26 and pegs 46 from rotating with respect to mounting sleeve 41 without mounting post 26 being simultaneously raised and rotated. In such embodiment, support arm sleeve 23 is rotable with respect to mounting post 26. In a mounted position, if support arm sleeve 23 or support arm 22 is rotated out of alignment, mounting post 26 can be raised, adjusted to an aligned position, then lowered to a readjusted fixed position.

Figure 5:
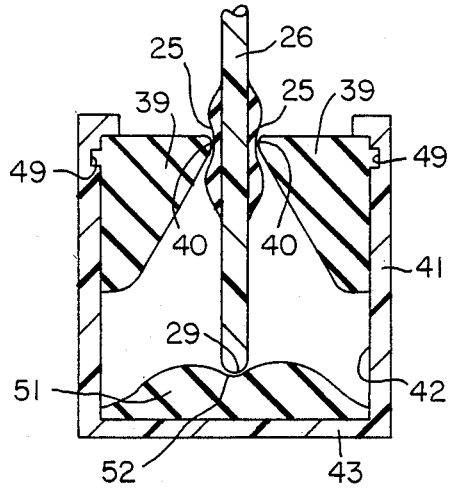
FIG. 5 shows a cross-sectional view of a mounting sleeve, retainer, mounting post and a rib-shaped gasket according to one embodiment of this invention.

According to such embodiment as shown in FIG. 4, mounting post 26 can have notched section 32 which has the same function as notched section 32 described in FIG. 3. FIG. 5 shows an alternate upper retaining means for supporting mounting post 26 in an approximately vertical position. Rib-shaped gasket 39 has an approximately right triangle cross-sectional shape with rounded corners. Looking at a top view, rib-shaped gasket 39 has an overall ring shape. A projecting portion of rib-shaped gasket 39 tightly fits within gasket retainer grove 49 of inner wall 42 to retain rib-shaped gasket 39 in an abutted position against inner wall 42. It is apparent that other suitable retaining means can be used to retain rib-shaped gasket 39 in an abutted position against inner wall 42 or the outer wall of mounting sleeve 41.

Mounting post 26 has mounting post depression 25 located around the circumference of mounting post 26. Contact surface 40 of rib-shaped gasket 39 tightly abuts mounting post depression 25 to retain mounting post 26 in an approximately vertical position and to seal the space within mounting sleeve 41. Retainer 29 is secured to mounting sleeve bottom 43. Mounting post bottom 29 makes contact with depression 52 of retainer 51 and mounting post 26 is thus retained in an approximately vertical position.

Upon displacement of mounting post 26, rounded mounting post bottom 29 moves out of depression 52. Mounting post 26 can then be repositioned into an approximately vertical position by lifting mounting post 26 upward thereby deflecting contact surface 40 of rib-shaped gasket 39 and setting mounting post bottom 29 back into depression 52 of retainer 51. It is apparent that rib-shaped gasket 39 ca have other cross-sectional shapes having contact surface 40 such as a circle, a corrugated surface, or any other suitable shape known to the art.

FIG. 6 shows a side view of housing 17 secured to support arm 22 which is secured to mounting post 26 according to one embodiment of this invention. It is apparent that support arm 22 can have two sleeve ends or two male ends or any combination of one male end and one sleeve end. It is also apparent that support arm 22 can have two or more connected members. It is also apparent that housing 17, support arm 22 and mounting post 26 can be secured by a screwed connection, a clamped connection, or by any other suitable connecting method known to the art.

Figure 7:
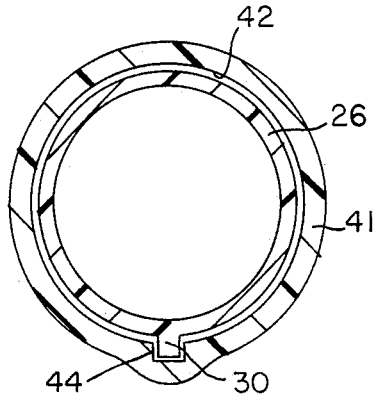
FIG. 7 shows a cross-sectional top view of a mounting post with a keeper bar and a mounting sleeve with a notch according to one embodiment of this invention.

FIG. 7 shows a cross-sectional top view of mounting post 26 having keeper bar 30 secured to the outer surface of mounting post 26. Mounting post 26 fits within mounting sleeve 41. Inner wall 42 of mounting sleeve 41 has at least one vertically positioned inner wall groove 44 which accepts keeper bar 30 of mounting post 26. Keeper bar 30 mated with inner wall groove 44 prevents mounting post 26 from rotating within and relative to mounting sleeve 41. Such non-rotation prevents housing 17 from rotating when a slight force is applied to housing 17 or support arm 22, such as a force due to the wind or the like. Keeper bar 30 can be designed to break away from mounting post 26 upon a certain force. Thus, according to the embodiment shown in FIG. 7, mounting post 26 can be prevented from rotating with respect to mounting sleeve 41 unless a substantial torque force is applied to mounting post 26. In the event of such a substantial torque applied to mounting post 26, keeper bar 30 will break away from mounting post 26 allowing mounting post 26 to rotate rather than break due to torsional forces.

Figure 8:
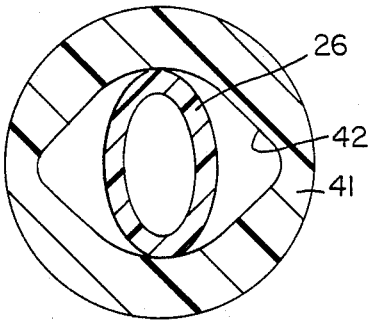
FIG. 8 shows a cross-sectional top view of a mounting post having an elliptical outside cross section fitting within a mounting sleeve having an inside elliptical cross section according to one embodiment of this invention.

FIG. 8 shows a cross-sectional top view of mounting post 26 within mounting sleeve 41 according to another embodiment of this invention. Mounting post 26 has an elliptical outer surface cross-sectional shape. Mounting sleeve 41 has an elliptical inner surface cross-sectional shape. As shown in FIG. 8, the major axis of the outer surface of mounting post 26 is in a position perpendicular to the major axis of the ellipse formed by the inner surface of mounting sleeve 41. In such position, mounting post 26 tightly fits within mounting sleeve 41. Such tight fit will prevent rotation of mounting post 26 relative to mounting sleeve 41 due to a slight torquing force caused by the wind upon housing 17 or support arm 22, or the like. A substantial torquing force applied mounting post 26 will cause mounting post 26 to rotate within mounting sleeve 41 thereby preventing any damage to mounting post 26, housing 17, or support arm 22.

Figure 9:
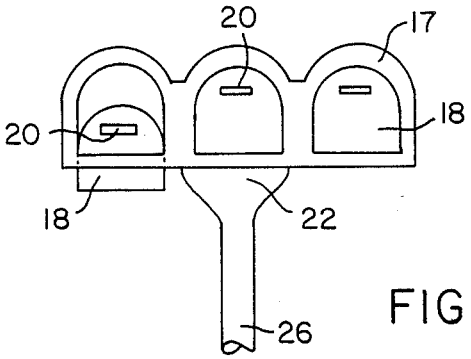
FIG. 9 shows a front view of a sheltered and repositionably mounted enclosure having a plurality of housings according to yet another embodiment of this invention.

FIG. 9 shows housing 17 having three separate enclosures, each enclosure having one access door 18. It is apparent that any number of housing enclosures can be formed by housing 17.

In a preferred embodiment of this invention, housing 17, access door 18, support arm 22 and/or mounting post 26 are made from a relatively rigid plastic material. Inner gasket 31 and outer gasket 33 are made from a rigid elastomeric material. Retainer 51 is made from a relatively pliable rubber or plastic material. Mounting sleeve 41 and mounting sleeve bottom 43 are made from a plastic or metal material. Upon reading this disclosure, it will become apparent to a person skilled in the art that other suitable materials exist for all of the members and components of this invention.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of the invention.

I claim:

1. A sheltered and repositionably mounted enclosure comprising:

a housing, a mounting post, said housing secured to and supported by said mounting post;

a mounting sleeve, said mounting post positioned within said mounting sleeve, upper retaining means for supporting said mounting post within said mounting sleeve, said upper retaining means attached to said mounting sleeve; and lower retaining means for supporting said mounting post in an approximately vertical position within said mounting sleeve, said mounting post repositionable within said mounting sleeve and with respect to said lower retaining means after being displaced from said lower retaining means.

2. A sheltered and repositionably mounted enclosure according to claim 1 wherein said housing further comprises: an access door, an access door channel, said access door slidably mounted within said access door channel, said access door sealing said housing, and stop means for slidably retaining said access door within said access door channel.

3. A sheltered and repositionably mounted enclosure according to claim 1 wherein said housing and said mounting post form one piece.

4. A sheltered and repositionably mounted enclosure according to claim 1 further comprising a support arm and said mounting post secured to said support arm.

5. A sheltered and repositionably mounted enclosure according to claim 4 further comprising: said mounting post having a breakable portion located above a mounting sleeve top of said mounting sleeve and below a support arm bottom of said support arm, and upon a force applied to the sheltered and repositionably mounted enclosure structural failure first occurring at said breakable portion.

6. A sheltered and repositionably mounted enclosure according to claim 1 further comprising: a housing neck secured to said housing, said support arm having a housing end opposite said mounting post end, and said housing end secured to said housing neck.

7. A sheltered and repositionably mounted enclosure according to claim 1 wherein said upper retaining means further comprises: an outer ring-shaped gasket, an inner ring-shaped gasket secured to said mounting post, said outer ring-shaped gasket attached to said mounting sleeve, and said inner ring-shaped gasket and said outer ring-shaped gasket forming a seal and contacting said mounting post at a mounting post position above said lower retaining means for fixing said mounting post in said approximately vertical position.

8. A sheltered and repositionably mounted enclosure according to claim 7 further comprising: said inner ring-shaped gasket having a downward sloping outer side, said outer ring-shaped gasket having an upward sloping inner side, and said downward sloping outer side abutting said upward sloping inner side thereby forming a sealed space within said mounting sleeve and fixing said mounting post in said approximately vertical position.

9. A sheltered and repositionably mounted enclosure according to claim 1 further comprising: a plurality of bolts, a plurality of nuts, a plurality of washers, said upper retaining means having a plurality of through holes, said mounting sleeve having a plurality of through slots aligning with said through holes, said through slots positioned approximately vertically, each said bolt extending through said through hole and said through slot, said washer fitting over said bolt, and nut threads of said nut matingly engaging with bolt threads of said bolt for drawing said upper retaining means against an inner wall of said mounting sleeve.

10. A sheltered and repositionably mounted enclosure according to claim 9 wherein said upper retaining means abuts said inner wall of said mounting sleeve forming a seal.

11. A sheltered and repositionably mounted enclosure according to claim 1 wherein said lower retaining means further comprises: a retainer having a mound shape with a depression in the middle portion of said mound, said retainer attached to a mounting sleeve bottom of said mounting sleeve, and a mounting post bottom of said mounting post retainable within said depression of said retainer fixing said mounting post in said approximately vertical position.

12. A sheltered and repositionably mounted enclosure according to claim 1 further comprising: said mounting sleeve having at least one curved notch positioned at a mounting sleeve top of said mounting sleeve, at least one peg secured to an outer wall of said mounting post, and said peg mating with said notch for supporting said mounting post and fixing said approximately vertical position of said mounting post with respect to said mounting sleeve.

13. A sheltered and repositionably mounted enclosure according to claim 1 wherein said mounting post has non-rotating means for retaining a rotational position of said mounting post with respect to said mounting sleeve.

14. A sheltered and repositionably mounted enclosure according to claim 13 wherein said non-rotating means further comprises: said mounting post fitting within said mounting sleeve, a keeper bar secured to an outside wall of said mounting post, an inner wall of said mounting sleeve, an inner wall groove located on said inner wall of said mounting sleeve, said keeper bar mating with said inner wall groove to prevent said mounting post from rotating with respect to said mounting sleeve.

15. A sheltered and repositionably mounted enclosure according to claim 13 wherein said non-rotating means further comprises: said mounting post fitting within said mounting sleeve, said mounting post having an outer surface with an elliptical cross section, said mounting sleeve having an inner surface with an elliptical cross section, said mounting post partially rotable within said mounting sleeve, and at a locking position said mounting post rotating into a snug fit within said mounting sleeve.

16. A sheltered and repositionably mounted enclosure according to claim 1 wherein said mounting post has mounting post flats for rotating said mounting post and said mounting post flats are secured to said mounting post at a location above said upper retaining means.

17. A sheltered and repositionably mounted enclosure according to claim 1 further comprising: said mounting post having a section of external threads, said upper retaining means having internal threads, and said internal threads mating with said external threads vertically displacing said upper retaining means.

18. A sheltered and repositionably mounted enclosure according to claim 1 wherein said upper retaining means further comprises: a rib-shaped gasket, a rib-shaped gasket outer side attached to an inner wall of said mounting sleeve, and rib-shaped gasket inner side abutting an outer surface of said mounting post.

19. A sheltered and repositionably mounted enclosure according to claim 18 wherein said rib-shaped gasket has an approximately right triangle cross section with rounded corners, a mounting sleeve side of said rib-shaped gasket attached to said inner wall, and a corner of said approximately right triangle cross section opposing said mounting sleeve side contacting said outer surface of said mounting post, said mounting post pivoting at said rib-shaped gasket upon a force applied to the sheltered and repositionably mounted enclosure.

20. An improved mounting for mounting a post in the ground, the improvement comprising:

a mounting sleeve, said post positioned within said mounting sleeve, upper retaining means for supporting said post within said mounting sleeve, said upper retaining means attached to said mounting sleeve;

said upper retaining means comprising an outer ring-shaped gasket, an inner ring-shaped gasket secured to said post, said outer ring-shaped gasket attached to said mounting sleeve, and said inner ring-shaped gasket and said outer ring-shaped gasket forming a seal and contacting said post at a post position above said lower retaining means for fixing said post in said approximately vertical position; and lower retaining means for supporting said post in an approximately vertical position within said mounting sleeve, said post repositionable within said mounting sleeve and with respect to said lower retaining means after being displaced from said lower retaining means.

21. An improved mounting according to claim 20 further comprising: said inner ring-shaped gasket having a downward sloping outer side, said outer ring-shaped gasket having an upward sloping inner side, and said downward sloping outer side abutting said upward sloping inner side thereby forming a sealed space within said mounting sleeve and fixing said post in said approximately vertical position.

22. An improved mounting according to claim 20 further comprising: a plurality of bolts, a plurality of nuts, a plurality of washers, said upper retaining means having a plurality of through holes, said mounting sleeve having a plurality of through slots aligning with said through holes, said through slots positioned approximately vertically, each said bolt extending through said through hole and said through slot, said washer fitting over said bolt, and nut threads of said nut matingly engaging with bolt threads of said bolt for drawing said upper retaining means against an inner wall of said mounting sleeve.

23. An improved mounting according to claim 22 wherein said upper retaining means abuts said inner wall of said mounting sleeve forming a seal.

24. An improved mounting according to claim 20 wherein said lower retaining means further comprises: a retainer having a mound shape with a depression in the middle portion of said mound, said retainer attached to a mounting sleeve bottom of said mounting sleeve, and a post bottom of said post retainable within said depression of said retainer fixing said post in said approximately vertical position.

25. An improved mounting according to claim 20 further comprising: said mounting sleeve having at least one curved notch positioned at a mounting sleeve top of said mounting sleeve, at least one peg secured to an outside wall of said post, and said peg mating with said notch for supporting said post and fixing said approximately vertical position of said post with respect to said mounting sleeve.

26. An improved mounting according to claim 20 wherein said post has post flats for rotating said post and said post flats are secured to said post at a location above said upper retaining means.

27. An improved mounting according to claim 20 further comprising: said post having a section of external threads, said upper retaining means having internal threads, and said internal threads mating with said external threads vertically displacing said upper retaining means.

28. An improved mounting according to claim 20 wherein said upper retaining means further comprises: a rib-shaped gasket, a rib-shaped gasket outer side attached to an inner wall of said mounting sleeve, and a rib-shaped gasket inner side abutting an outer surface of said post.

29. An improved mounting according to claim 28 wherein said rib-shaped gasket has an approximately right triangle cross section with rounded corners, a mounting sleeve side of said rib-shaped gasket attached to said inner wall, and a corner of said approximately right triangle cross section opposing said mounting sleeve side contacting said outer surface of said post, said post pivoting at said rib-shaped gasket upon a force applied to said post.

* * * * *